United States Patent [19]

Ogawa et al.

[11] Patent Number: 4,786,340

[45] Date of Patent: Nov. 22, 1988

[54] SOLUTION HEAT-TREATED HIGH STRENGTH ALUMINUM ALLOY

[75] Inventors: Masahiro Ogawa; Tuneo Ueno; Hideki Iwai, all of Ube, Japan

[73] Assignee: Ube Industries, Ltd., Ube, Japan

[21] Appl. No.: 910,459

[22] Filed: Sep. 23, 1986

[30] Foreign Application Priority Data

Sep. 27, 1985 [JP] Japan ..... 60-212674

[51] Int. Cl.[4] ..... C22C 21/02

[52] U.S. Cl. ..... 148/439; 148/159; 148/417

[58] Field of Search ..... 420/534, 535; 148/437, 148/438, 439, 417, 3, 159

[56] References Cited

U.S. PATENT DOCUMENTS 4,068,645 1/1978 Jenkinson ..... 148/437
4,077,810 3/1978 Ohuchi et al. ..... 148/3

FOREIGN PATENT DOCUMENTS 1255928 12/1967 Fed. Rep. of Germany .
2418389 10/1974 Fed. Rep. of Germany .
2011660 3/1970 France .
2225534 11/1974 France .
53-6612 5/1973 Japan .
55-69234 5/1980 Japan .
55-149771 11/1980 Japan .
1169104 10/1969 United Kingdom .
1437144 5/1976 United Kingdom .

OTHER PUBLICATIONS

Altenpohl, "Aluminum und Aluminiumlegierungen, 1965, p. 31.

*Primary Examiner*—R. Dean
*Attorney, Agent, or Firm*—Finnegan, Henderson, Farabow, Garrett & Dunner

[57] ABSTRACT

A high strength aluminum alloy including 5 to 13 wt % Si, 1 to 5 wt % Cu, 0.1 to 0.5 wt % Mg, 0.005 to 0.3 wt % Sr, and the balance Al and inevitable impurities. The aluminum alloy is subjected to pressure casting and T6 heat treatment. The solution treatment time can be shortened.

5 Claims, 4 Drawing Sheets

SOLUTION HEAT-TREATED HIGH STRENGTH ALUMINUM ALLOY

BACKGROUND OF THE INVENTION

1. Field of The Invention

The present invention relates to an aluminum alloy, more particularly, to a high strength aluminum alloy and for pressure casting, such as pressure die casting, gravity die casting, and squeeze casting. The aluminum alloy is heat treated to obtain its superior mechanical properties.

2. Description of the Related Art

Al-Si-Cu-Mg alloy members or parts including 5 to 13 wt % silicon, 1 to 5 wt % copper, and 0.1 to 0.5 wt % magnesium are formed by pressure casting and then subjected to T6 treatment resulting in a tensile strength of approximately 40 kg/mm$^2$ and an elongation of from 5% to 10%. These are thus suitable as engine parts of automobile and ships, safety parts, mechanical parts, and the like.

In the T6 treatment, the members are subjected to solution heat treatment where theyaare held at a temperature of from 480° C. to 540° C. for 4 to 10 hours quenched and then subjected to artificial aging at a temperature of from 150° C. to 200° C. for 3 to 8 hours. Thus, the treating time is relatively long and is undesirable in terms of production efficiency. A typical Al-Si-Cu-Mg alloy now in use, incidentally, is AC4D [JIS H 5202 (1977)], corresponding to AA355.0.

SUMMARY OF THE INVENTION

An object of the present invention is to provide an improved alloy of the Al-Si-Cu-Mg system suitable for heat-treatment and pressure casting.

Another object of the present invention is to improve the mechanical properties, especially, the toughness, i.e., tensile strength and elongation, of an Al-Si-Cu-Mg alloy member formed by die casting and subjected to T6 treatment.

Still another object of the present invention is to shorten the time of the solution heat treatment in T6 treatment.

These and other objects of the present invention are attained by a high strength aluminum alloy for pressure casting comprising 5 to 13 wt % silicon, 1 to 5 wt % copper, 0.1 to 0.5 wt % magnesium, 0.005 to 0.3 wt % strontium, and the balance aluminum and inevitable impurities.

BRIEF DESCRIPTION OF THE DRAWINGS

The present invention will become more apparent from the description of the examples and a comparative example set forth below with reference to the accompanying drawings, wherein.

DESCRIPTION OF THE PREFERRED EMBODIMENTS

Figure 1:
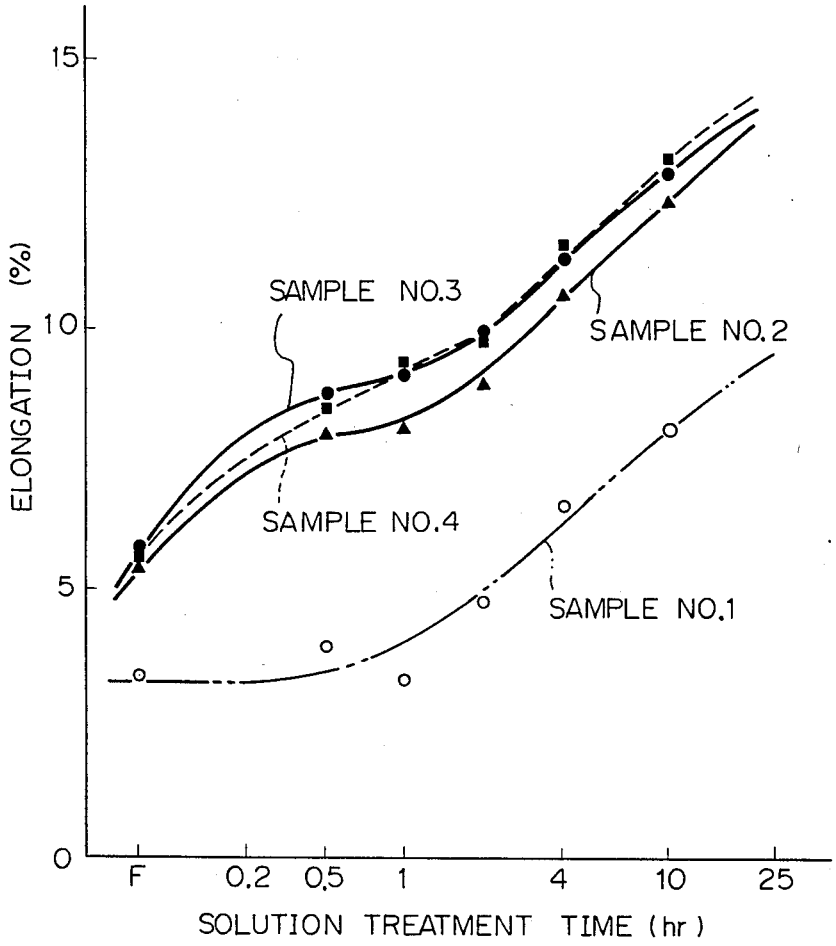
FIG. 1 is a graph showing the relationship between solution treatment time and elongation.

According to the present invention, the addition of strontium (Sr) into the Al-Si-Cu-Mg alloy reduces the solution heat treatment time and raises the mechanical properties.

The reasons for limiting the components of the Al-Si-Cu-Mg alloy within the above-mentioned ranges are explained below.

The percent ranges of 5% to 13% silicon, 1% to 5% copper, and 0.1% to 0.5% magnesium are those of a conventional Al-Si-Cu-Mg alloy. Silicon is a principal additive in most aluminum casting alloys. It strengthens the alloy matrix and improves the fluidity of the molten metal, reduces shrinkage, prevents casting cracks; etc.

However, less than 5% of silicon is ineffective, and more than 13% of silicon remarkably decreases the toughness.

Copper can produce a remarkable increase in strength due to age hardening when the aluminum alloy is heat-treated. Less than 1% of copper is ineffective, and more than 5% decreases the toughness.

Magnesium strengthens the alloy matrix by precipitating $Mg_2Si$ upon heat-treatment. In order to bring about such an effect in the Al-Si-Cu-Mg alloy, more than 0.1% of magnesium should be added. However, it is undesirable to add more than 0.5% of magnesium as it decreases the toughness.

The addition of 0.005% to 0.3% of strontium (Sr) substantially shortens the solution heat treatment time when an aluminum alloy member formed by pressure casting is subjected to T6 treatment to improve the toughness. Less than 0.005% reduces the shortening effect however and more than 0.3% is ineffective for further shortening the treatment time.

It is preferable to add 0.05% to 0.5% of titanium, or to add 0.05% to 0.5% of titanium and 0.05% to 0.3% of boron, into the aluminum alloy of Al-Si-Cu-Mg-Sr system to further improve the toughness.

Since iron (Fe), a general impurity contained in the aluminum alloy, decreases the toughness, it is preferable to control the iron content to below 0.5%. Furthermore, in order to prevent magnesium from oxidizing when the raw materials are melted, it is possible to add up to 0.05% beryllium (Be), which addition does not impair the effects of the present invention.

In the heat treatment for the aluminum alloy according to the present invention, the temperatures for the solution treatment and the artificial aging are from 480° C. to 540° C. and from 140° C. to 200° C., respectively. These temperature ranges are those ordinarily adopted for conventional Al-Si-Cu-Mg alloys.

According to the present invention, the solution treatment time may be from approximately 0.5 to 2 hours, which time is considerably shorter than the 4 to 10 hours necessary for obtaining the maximum tensile strength and elongation in conventional Al-Si-Cu-Mg alloys, and attains substantially the same strength and elongation. The heating time of the artificial aging for the aluminum alloy according to the present invention can be slightly shortened as compared with the ordinary heating time for artificial aging for the conventional Al-Si-Cu-Mg alloys. Furthermore, it is possible to adopt room temperature aging (i.e., natural aging) or preaging at a temperature of from 60° C. to 120° C. for several hours prior to such artificial aging. Pretreatment alone is often adopted for conventional Al-Si-Cu-Mg alloys.

Turning now to some specific examples, aluminum alloy molten metals having chemical compositions (percent by weight) as shown in Table 1 were prepared.

TABLE 1

| Al alloy sample No. | Composition (wt %) | | | | | | |
|---|---|---|---|---|---|---|---|
| | Cu | Si | Mg | Fe | Ti | Sr | B |
| Comparative Example | | | | | | | |
| No. 1 | 3.82 | 8.62 | 0.38 | 0.18 | — | — | — |
| Present invention | | | | | | | |
| No. 2 | 3.87 | 8.62 | 0.37 | 0.18 | — | 0.02 | — |
| No. 3 | 3.85 | 8.59 | 0.35 | 0.20 | 0.18 | 0.02 | — |
| No. 4 | 3.80 | 8.65 | 0.34 | 0.19 | 0.19 | 0.02 | 0.13 |

In each case, the molten metal was cast into a metal mold of a die casting machine at an injection pressure of 1,000 kg/cm$^2$ and an injection rate of 5 cm/sec. to form an aluminum alloy member. The metal mold was formed as a cup having a diameter of approximately 100 mm, a thickness of 10 mm, and a height of 120 mm. The obtained alloy members were subjected to solution treatment at 500° C. for a predetermined time, to water quenching, and then to artificial aging at 180° C. for 2 hours. Each of the treated alloy members was tested for tensile strength by a universal testing machine.

Figure 2:
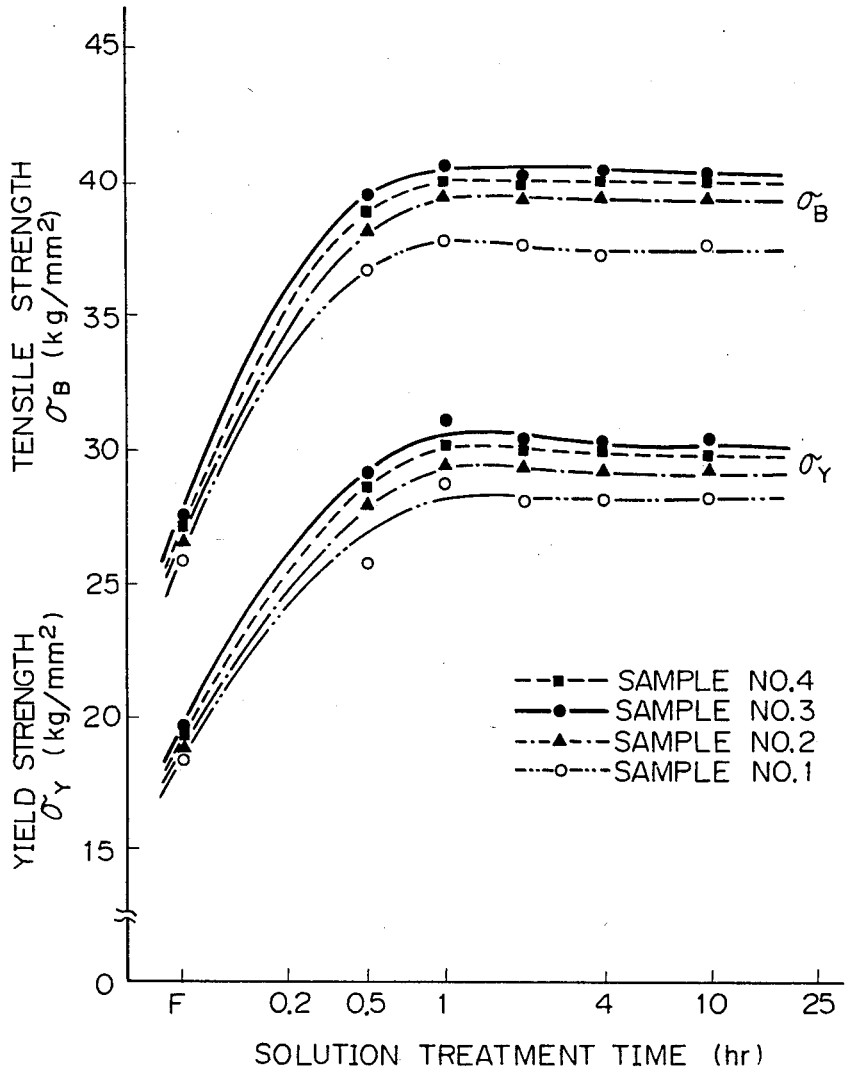
FIG. 2 is a graph showing the relationship between solution treatment time, tensile strength, and yield strength.

The relationship between the solution treatment time and the elongation of the members obtained from the data is shown in FIG. 1. The relationship between the solution treatment time and the tensile strength $\sigma_B$ and yield strength $\sigma_Y$(0.2% yield point) is shown in FIG. 2. Note "F" in FIGS. 1 and 2 indicates "as fabricated".

As seen in FIGS. 1 and 2, for example, an elongation of 8% can be obtained in aluminum alloys of the present invention (Sample Nos. 3, 4 and 2) after approximately 20 minutes to 1 hour of solution treatment while the same elongation can only be obtained in the comparative aluminum alloy (Sample No. 1), i.e., a conventional Al-Si-Cu-Mg alloy after, approximately 10 hours treatment. As FIG. 1 shows, the aluminum alloys of the present invention can be given high elongations by solution treatments shorter then conventional aluminum alloys. Furthermore, as shown in FIG. 2, the tensile strength and yield strength of the aluminum alloys of the present invention are higher than those of conventional aluminum alloys.

In order to clarify the relationship between the injection pressure and the mechanical properties, Samples Nos. 1 and 3 were used to make aluminum alloy members.

Each of molten metals was cast into the metal mold under predetermined injection conditions to form an aluminum alloy member. The obtained members were subjected to solution treatment at 500° C. for 4 hours, to water quenching, and then to artificial aging at 180° C. for 2 hours. A tensile test was carried out on each of the members.

Figure 3:
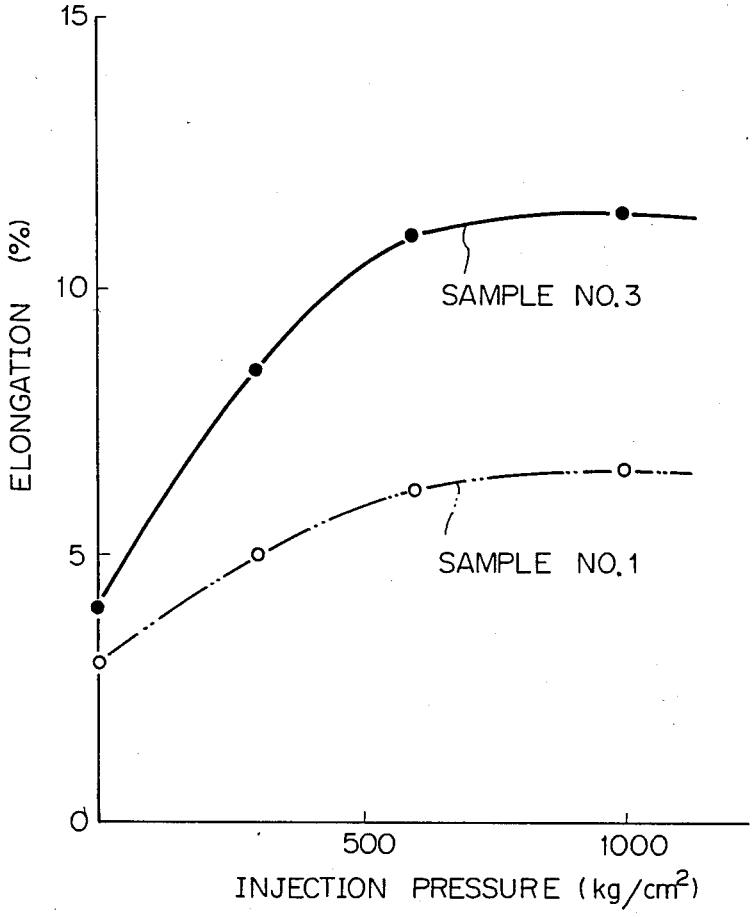
FIG. 3 is a graph showing the relationship between injection pressure in die casting and elongation.
Figure 4:
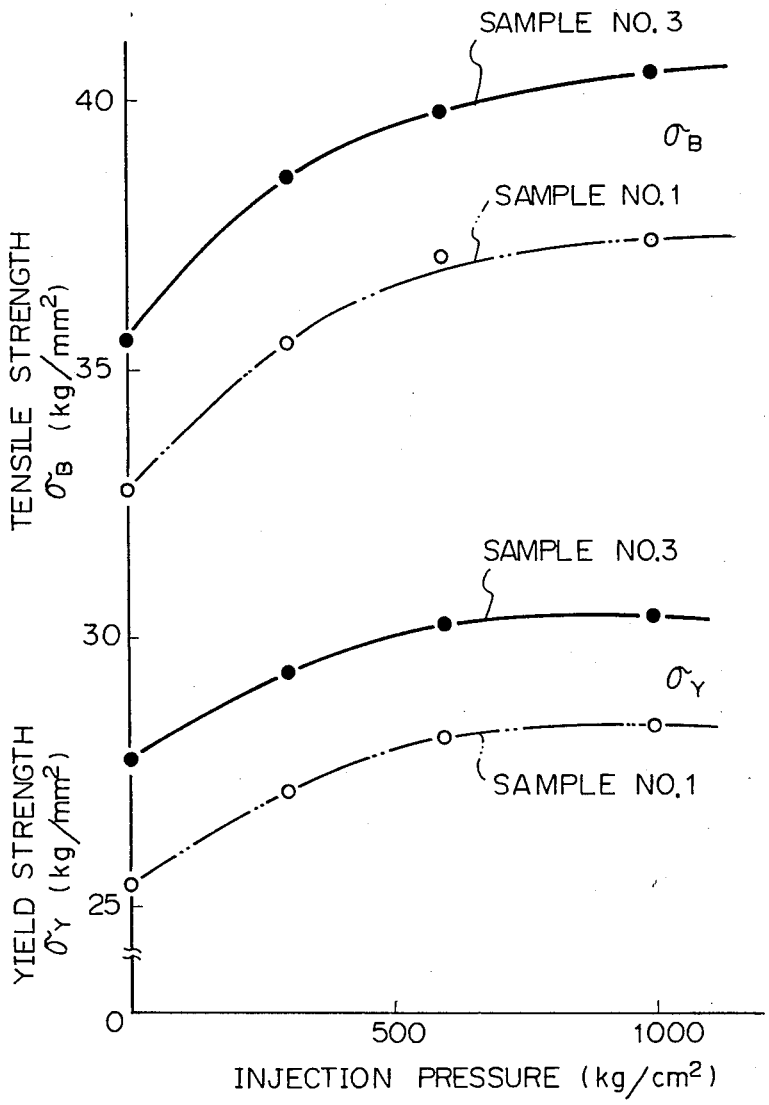
FIG. 4 is a graph showing the relationship between injection pressure, tensile strength and yield strength.

The obtained relatonship between the injection pressure of die casting and elongation is shown in FIG. 3. The relationship between injection pressure and tensile strength and yield strength is shown in FIG. 4. It is apparent from FIGS. 3 and 4 that the elongation, tensile strength, and yield strength of the aluminum alloy (Sample No. 3) of the present invention are considerably better than those of the comparative (conventional) aluminum alloy (Sample No. 1).

As mentioned above, the aluminum alloy of the present invention can be given high strength and very high elongation by pressure casting, short solution treatment, and artificial aging. Therefore, the aluminum alloy is advantageous in terms of applications, productivity, and production costs.

It will be obvious that the present invention is not restricted to the above-mentioned embodiments and that many variations are possible for persons skilled in the art without departing from the scope of the invention.

We claim:

1. A solution heat-treated high strength aluminum alloy for pressure casting, said alloy consisting essentially of 5 to 13 wt % silicon, 1 to 5 wt % copper, 0.1 to 0.5 wt % magnesium, 0.005 to 0.3 wt % strontium, and the balance aluminum and inevitable impurities, said alloy being rendered to substantially a solid solution at elevated temperatures in significantly less than four hours.

2. The alloy of claim 1, wherein the alloy is rendered to substantially a solid solution in approximately 0.5 to 2 hours through solution treatment at a temperature in the range from about 480° C. to about 540° C.

3. The alloy of claim 1, wherein the alloy consists essentially of 5 to 13 wt % silicon, 1 to 5 wt % copper, 0.1 to 0.5 wt % magnesium, 0.005 to 0.3 wt % strontium, 0.05 to 0.5 wt % titanium, and the balance aluminum and inevitable impurities.

4. The alloy of claim 1, wherein the alloy consists essentially of 5 to 13 wt % silicon, 1 to 5 wt % copper, 0.1 to 0.5 wt % magnesium, 0.005 to 0.3 wt % strontium, 0.05 to 0.5 wt % titanium, 0.05 to 0.3 wt % boron, and the balance aluminum and inevitable impurities.

5. The alloy of claim 4, wherein one of said impurities is less than 0.5 wt % iron.

* * * * *